US010400794B2

(12) United States Patent
Kurihara et al.

(10) Patent No.: US 10,400,794 B2
(45) Date of Patent: Sep. 3, 2019

(54) FAN AND AIR-CONDITIONING APPARATUS USING THE SAME

(71) Applicant: Mitsubishi Electric Corporation, Tokyo (JP)

(72) Inventors: Makoto Kurihara, Tokyo (JP); Kazuki Isomura, Tokyo (JP); Masahiko Takagi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 258 days.

(21) Appl. No.: 15/519,188

(22) PCT Filed: Jan. 16, 2015

(86) PCT No.: PCT/JP2015/051069

§ 371 (c)(1),
(2) Date: Apr. 14, 2017

(87) PCT Pub. No.: WO2016/113900

PCT Pub. Date: Jul. 21, 2016

(65) Prior Publication Data

US 2017/0234331 A1 Aug. 17, 2017

(51) Int. Cl.
*F04D 29/28* (2006.01)
*F04D 29/66* (2006.01)

(52) U.S. Cl.
CPC ..... *F04D 29/666* (2013.01); *F04D 29/281* (2013.01)

(58) Field of Classification Search
CPC ..... F04D 29/666; F04D 29/281; F04D 29/282
USPC ..... 416/186 R
See application file for complete search history.

(56) References Cited

FOREIGN PATENT DOCUMENTS

| | | |
|---|---|---|
| GB | 2 046 360 A | 11/1980 |
| JP | 05-223093 A | 8/1993 |
| JP | 06-017791 A | 1/1994 |

OTHER PUBLICATIONS

Extended EP Search Report dated Aug. 22, 2018 issued in corresponding EP patent application No. 15877852.2.
Office Action dated Dec. 5, 2017 issued in corresponding JP patent application No. 2016-569195 (and English translation).

(Continued)

*Primary Examiner* — Hai H Huynh
(74) *Attorney, Agent, or Firm* — Posz Law Group, PLC

(57) ABSTRACT

A fan according to the present invention includes: a main plate fixed to a rotation axis of a driving device; a shroud including an air inlet; and an impeller including n blades between the main plate and the shroud, tip ends of leading edges of the respective blades arranged along a circle around the rotation axis, wherein all of the attachment pitch angles $\alpha$ are different angles, and the blades are arranged so that, in the attachment pitch angles $\alpha$, attachment pitch angles on both sides of an attachment pitch angle $\alpha_m$ are a combination of other than an attachment pitch angle $\alpha_{m-1}$, which is the next smallest angle in order of magnitude of angle to the attachment pitch angle $\alpha_m$, and an attachment pitch angle $\alpha_{m+1}$, which is the next largest angle in order of magnitude of angle, to the attachment pitch angle $\alpha_m$.

5 Claims, 5 Drawing Sheets

(56) References Cited

OTHER PUBLICATIONS

Office action dated Jul. 2, 2018 issued in corresponding CN patent application No. 201580066313.X (and English translation thereof).
International Search Report of the International Searching Authority dated Apr. 7, 2015 for the corresponding International application No. PCT/JP2015/051069 (and English translation).
Office action dated Jan. 16, 2019 issued in corresponding CN application No. 201580066313.X (and English translation thereof).

FAN AND AIR-CONDITIONING APPARATUS USING THE SAME

CROSS REFERENCE TO RELATED APPLICATION

This application is a U.S. national stage application of International Application No. PCT/JP2015/051069, filed on Jan. 16, 2015, the contents of which are incorporated herein by reference.

TECHNICAL FIELD

The present invention relates to a fan used in an air-conditioning apparatus or others.

BACKGROUND

In a conventional fan, in particular, in a centrifugal fan, two-dimensional blades in each of which no twisted form exists between a main plate and a shroud have been of a mainstream technique. Further, in pursuing reduction of noise and power consumption, a fan including three-dimensional blades with twisted forms among main plates and shrouds appeared and advance of performance has been sought.

Since the fan having the three-dimensional blades is able to address problems of noise, power consumption or others, it became possible to increase rotation speed. However, in general, a problem that a rotation sound (NZ sound) is likely to be generated has occurred by increasing the rotation speed of the fan.

Therefore, conventionally, for example, a technique for reducing the rotation sound by adopting a structure in which a minimum common divisor of combinations of the number of blades and a pitch angle of blade becomes a maximum value has been suggested (see, for example, Patent Literature 1).

Moreover, a technique for reducing the rotation sound by forming a leading edge shape of blade into a shape different by blade and arranging the blades so that a resultant vector of weight moment forces of respective blades becomes minimum is suggested (see, for example, Patent Literature 2).

PATENT LITERATURE

Patent Literature 1: Japanese Unexamined Patent Application Publication No. 6-017791

Patent Literature 2: Japanese Unexamined Patent Application Publication No. 5-223093

For example, in a device, such as an air-conditioning apparatus, it is extremely important to increase rotation speed of fan and increase air volume for saving energy, improving outreach of an air flow, and the like. However, for example, in a device, such as an air-conditioning apparatus, since the rotation speed of the fan has to be suppressed for keeping the rotation noise within a range that does not provide a sense of discomfort to a user, there has been a problem that it is not easy to increase the air volume.

SUMMARY

The present invention has been made to overcome the above-described problem, and has an object to obtain, for example, a fan or the like capable of suppressing a rotation sound even at high rotation speed.

A fan according to the present invention includes: a main plate fixed to a rotation axis of a driving device; a shroud including an air inlet; and an impeller including n number of blades, where $n \geq 3$, between the main plate and the shroud, tip ends of leading edges of the respective blades being arranged along a circle around the rotation axis, wherein, where an angle formed by the tip ends of the leading edges of the two adjacent blades and the rotation axis is an attachment pitch angle $\alpha$, all of the attachment pitch angles $\alpha$ are different angles, and the blades are arranged in such a manner that, in the attachment pitch angles $\alpha$, attachment pitch angles on both sides of an attachment pitch angle $\alpha_m$, where $2 \leq m \leq n-1$, are a combination of other than an attachment pitch angle $\alpha_{m-1}$, which is an angle next small, in order of magnitude of angle, to the attachment pitch angle $\alpha_m$, and an attachment pitch angle $\alpha_{m+1}$, which is an angle next large, in order of magnitude of angle, to the attachment pitch angle $\alpha_m$.

In the fan in the present invention, since each attachment pitch angle $\alpha_m$ is a different angle, and blades are arranged so that attachment pitch angles on both sides of an attachment pitch angle $\alpha_m$ are not a combination of an attachment pitch angle $\alpha_{m-1}$ and an attachment pitch angle $\alpha_{m+1}$, it is possible to reduce the rotation sound when the fan is driven.

DETAILED DESCRIPTION

Figure 1:
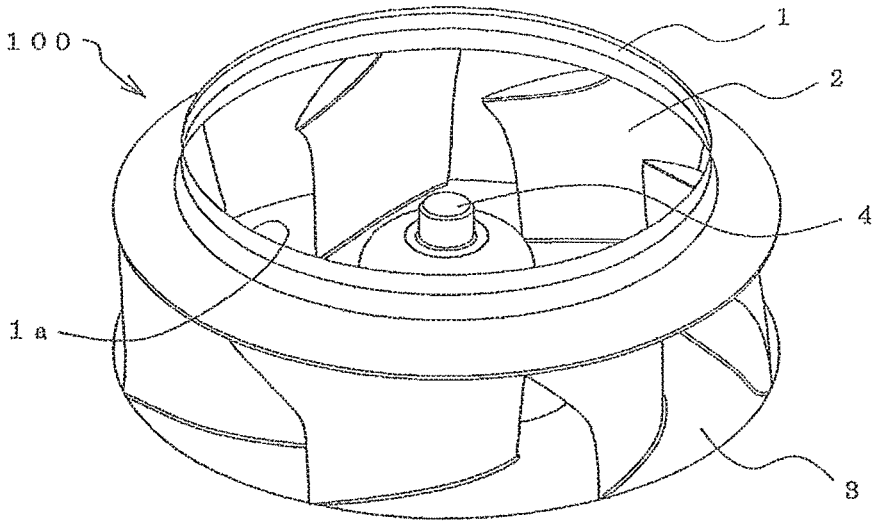
FIG. 1 is a perspective view showing a configuration of a portion in an impeller 100 of a fan according to Embodiment 1 of the present invention.

Hereinafter, embodiments for practicing the present invention will be described with reference to attached drawings. Here, regarding reference signs, those assigned with the same signs are the same or corresponding components, and this is common throughout in the specification. Then, forms of elements represented throughout in the specification are only exemplification, which do not limit the present invention to the forms described in the specification. In particular, a combination of elements is not limited to the combination in each embodiment; elements described in one embodiment can be applied to another embodiment. Moreover, it is assumed that a sign related to multiple blades is assigned only to one representative blade. Moreover, the number of blades shown in the drawings is an example. Further, a description will be given by assuming that, in the drawings, an upper portion on the sheet is an "upper side" and a lower portion thereof is a "lower side". Then, in the drawings, dimensional relationships of respective components are different from their actual sizes in some cases.

Embodiment 1

Figure 2:
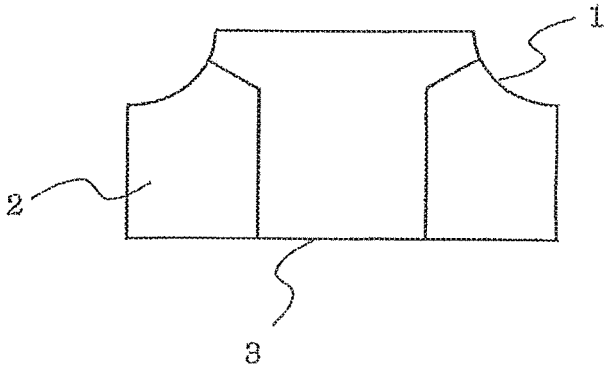
FIG. 2 is a diagram showing an outline configuration of a cross section of the impeller 100 of the fan according to Embodiment 1 of the present invention.

FIG. 1 is a perspective view showing a configuration of a portion in an impeller 100 of a fan according to Embodiment 1 of the present invention. Moreover, FIG. 2 is a diagram showing a schematic configuration of a cross section of the impeller 100 of the fan according to Embodiment 1 of the present invention. The impeller 100 of the fan (centrifugal fan) according to Embodiment 1 is, as shown in FIGS. 1 and 2, provided with multiple (seven in FIG. 1) blades 2 between a shroud (side plate) 1 and a main plate 3.

The shroud 1 is in a bell-mouth shape and includes an air inlet 1*a*. The blade 2 in this embodiment is a three-dimensional blade having a form twisted between the shroud 1 and the main plate 3. Therefore, it is possible to facilitate reduction of noise, power consumption, and so forth. Moreover, at a center part of the main plate 3, a boss 4 serving as a rotation axis portion is attached. A driving device (such as a fan motor) is attached to the boss 4 to rotate the impeller 100. When rotating, the impeller 100 sucks a gas (for example, air) from the rotation axis direction, and discharges the sucked gas in an outer circumferential direction intersecting the rotation axis. Here, the shroud 1, the blade 2 and the main plate 3 are formed of, for example, resin.

Figure 3:
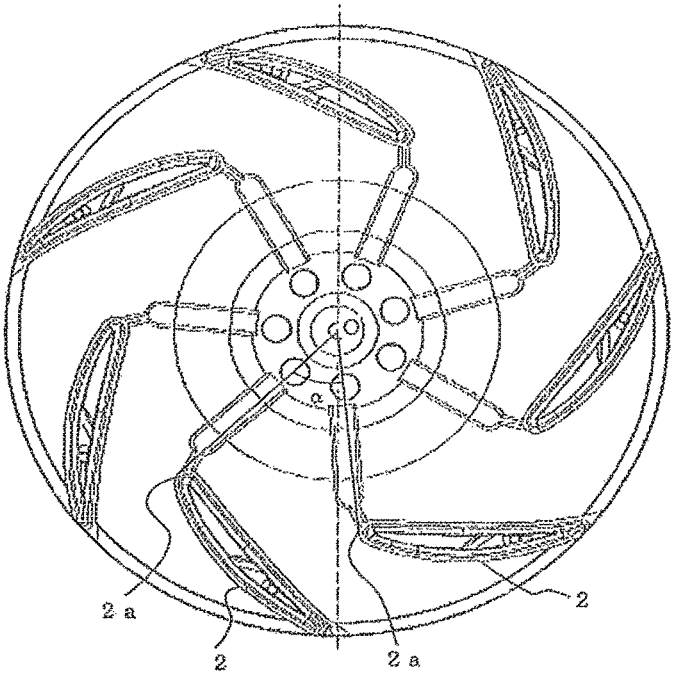
FIG. 3 is a diagram illustrating arrangement of blades 2 in the fan according to Embodiment 1 of the present invention.

FIG. 3 is a diagram illustrating arrangement of the blades 2 in the fan according to Embodiment 1 of the present invention. FIG. 3 shows the impeller 100 as viewed from the back side. As shown in FIG. 3, in each blade 2, an angle formed by tip ends 2*a* of respective leading edges of the two blades 2 and the rotation axis (center) O is assumed to be an attachment pitch angle $\alpha$[deg (°)]. When the fan has n ($n \geq 3$) blades 2, there exist n attachment pitch angles $\alpha$. In the fan of this embodiment, each blade 2 is arranged so that the size of each attachment pitch angle $\alpha$ is different. Here, it is assumed that the attachment pitch angles $\alpha$ are $\alpha_1, \ldots, \alpha_{m-1}, \alpha_m, \alpha_{m+1}, \ldots, \alpha_n$ in ascending order of magnitude of the angle ($2 \leq m \leq n-1$).

For example, the rotation sound generated by driving of the fan (rotation of the impeller 100) is generated due to periodic pressure variations caused by the blades 2 when the fan rotates the impeller 100. The frequency $f_{NZ}$ of the rotation sound is $f_{NZ}=N/60 \times n$ [Hz] (the total number of blades passing through a certain point in a second) based on a product of the rotation speed N [rpm] and the number n of the blades 2. Like the fan of this embodiment, by varying the attachment pitch angle $\alpha$ (setting the attachment pitch angle to a different angle), the number of blades n is effectively increased or decreased. The frequency related to the rotation sound is varied and periodicity of a sound wave is changed significantly, and therefore, the rotation sound can be suppressed. Moreover, by arranging so that the adjacent attachment pitch angles are not close to each other, it is possible to reduce the periodicity of the sound wave of the rotation sound. Here, although no particular limitation is imposed, in this embodiment, it is assumed that the rotation speed N is the maximum rotation speed, a rotation speed close to the maximum rotation speed, or a rotation speed generating the rotation sound for seeking reduction of rotation sound when the fan is operated at high rotation speed.

Figure 4:
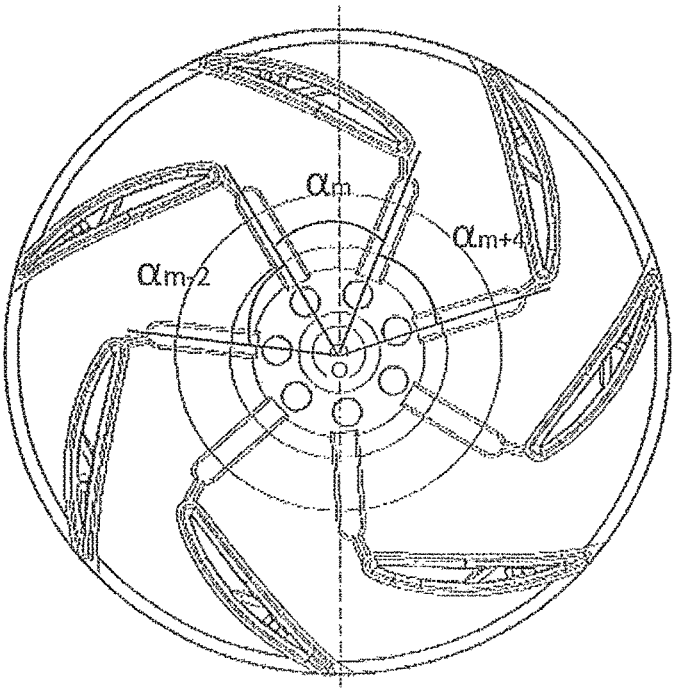
FIG. 4 is a diagram illustrating relation among attachment pitch angles $\alpha$ in the fan according to Embodiment 1 of the present invention.

FIG. 4 is a diagram illustrating relation among the attachment pitch angles $\alpha$ in the fan according to Embodiment 1 of the present invention. In the fan of this embodiment, the blades 2 are arranged so that the combination of attachment pitch angles $\alpha$ on both sides of the attachment pitch angle $\alpha_m$ is made by other than the attachment pitch angle $\alpha_{m-1}$ and the attachment pitch angle $\alpha_{m+1}$. For example, in FIG. 4, the attachment pitch angles $\alpha$ on both sides of the attachment pitch angle $\alpha_m$ are the attachment pitch angle $\alpha_{m-2}$ and the attachment pitch angle $\alpha_{m+4}$.

Figure 5:
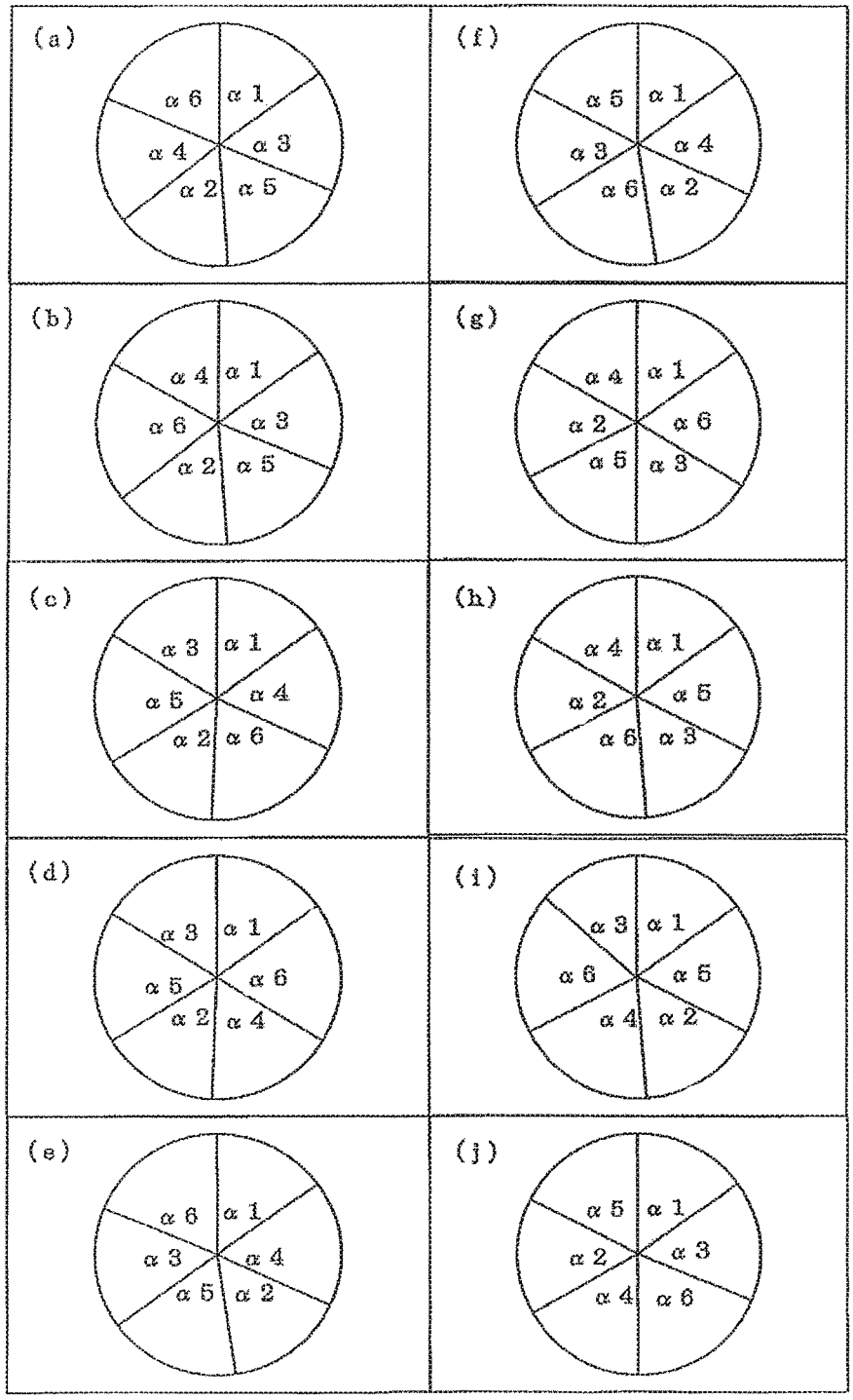
FIG. 5 is a diagram specifically showing the relation among the attachment pitch angles $\alpha$ in the fan according to Embodiment 1 of the present invention.

FIG. 5 is a diagram specifically showing the relation among the attachment pitch angles $\alpha$ in the fan according to Embodiment 1 of the present invention. FIG. 5 shows an example of a fan including six blades 2. As described above, the sizes of respective attachment pitch angles $\alpha$ are: $\alpha_1$ (54.00°)<$\alpha_2$ (56.25°)<$\alpha_3$ (58.50°)<$\alpha_4$ (60.75°)<$\alpha_5$ (63.00°)<$\alpha_6$ (67.50°). As shown in FIG. 5, when there are six blades 2, the order of the attachment pitch angles as viewed in a right hand turn (clockwise turn) with the attachment pitch angle $\alpha_1$ in the lead is ($\alpha_1, \alpha_3, \alpha_5, \alpha_2, \alpha_4, \alpha_6$), ($\alpha_1, \alpha_3, \alpha_5, \alpha_2, \alpha_6, \alpha_4$), ($\alpha_1, \alpha_4, \alpha_6, \alpha_2, \alpha_5, \alpha_3$), ($\alpha_1, \alpha_6, \alpha_4, \alpha_2, \alpha_5, \alpha_3$), ($\alpha_1, \alpha_4, \alpha_2, \alpha_5, \alpha_3, \alpha_6$), ($\alpha_1, \alpha_4, \alpha_2, \alpha_6, \alpha_3, \alpha_5$), ($\alpha_1, \alpha_6, \alpha_3, \alpha_5, \alpha_2, \alpha_4$), ($\alpha_1, \alpha_5, \alpha_3, \alpha_6, \alpha_2, \alpha_4$), ($\alpha_1, \alpha_5, \alpha_2, \alpha_4, \alpha_6, \alpha_3$) and ($\alpha_1, \alpha_3, \alpha_6, \alpha_4, \alpha_2, \alpha_5$). Consequently, there are ten combinations of attachment pitch angles $\alpha$ on both sides of the attachment pitch angle $\alpha_m$ made by other than the attachment pitch angle $\alpha_{m-1}$ and the attachment pitch angle $\alpha_{m+1}$.

As described above, according to the fan of Embodiment 1, since the multiple blades 2 are arranged so that each attachment pitch angle $\alpha_m$ is a different angle from one another, and the attachment pitch angles on both sides of the attachment pitch angle $\alpha_m$ are not a combination of the attachment pitch angle $\alpha_{m-1}$ and the attachment pitch angle $\alpha_{m+1}$, it is possible to reduce the rotation sound when the fan is driven. Here, the number of blades 2 is not particularly limited; however, in consideration of efficiency or others, a fan may be configured to have the blades 2 in a range of the number of 5 to 9.

Embodiment 2

In the above-described Embodiment 1, each blade 2 was arranged so that the size of each attachment pitch angle $\alpha$ was different. At this time, although not shown in Embodiment 1, a condition to be satisfied by the attachment pitch angle $\alpha_1$, which is the minimum angle of the attachment pitch angle $\alpha$, and the attachment pitch angle $\alpha_n$, which is the maximum angle, is defined in this embodiment for reducing the rotation sound more efficiently.

Figure 6:
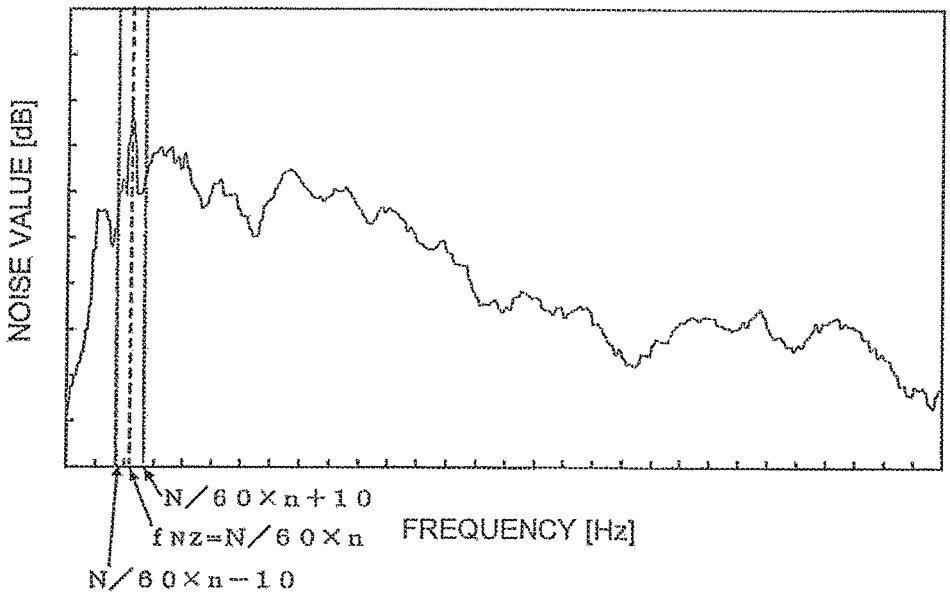
FIG. 6 is a diagram showing relation between a frequency and a rotation sound (noise) according to Embodiment 2 of the present invention.

FIG. 6 is a diagram showing relation between a frequency and a rotation sound (noise) according to Embodiment 2 of the present invention. In this embodiment, a frequency is displaced ±10 [Hz] or more with respect to the frequency $f_{NZ}$, which is related to the rotation sound determined by the number of blades 2 and the rotation speed N, and is dispersed. Here, the frequency higher than the frequency $f_{NZ}$ depends on the attachment pitch angle $\alpha_1$. Moreover, the frequency lower than the frequency $f_{NZ}$ depends on the attachment pitch angle $\alpha_n$. Accordingly, it is assumed that the attachment pitch angle $\alpha_1$ and the attachment pitch angle $\alpha_n$ satisfy the following expression (1) and expression (2).

[Expression 1]

$$N/60 \times 360/\alpha 1 \leq N/60 \times n + 10 \quad (1)$$

[Expression 2]

$$N/60\times360/\alpha n\leq N/60\times n-10 \quad (2)$$

Figure 7:
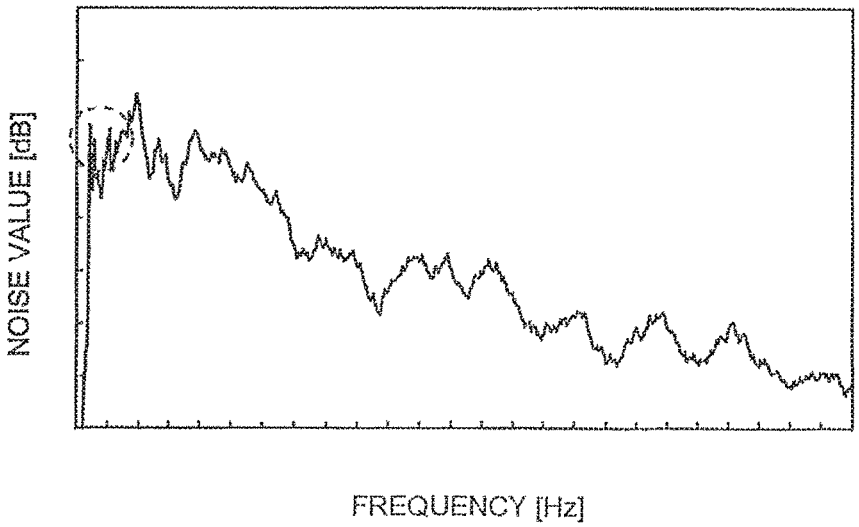
FIG. 7 is a diagram (the first) illustrating effects of rotation sound reduction by a fan according to Embodiment 2 of the present invention.
Figure 8:
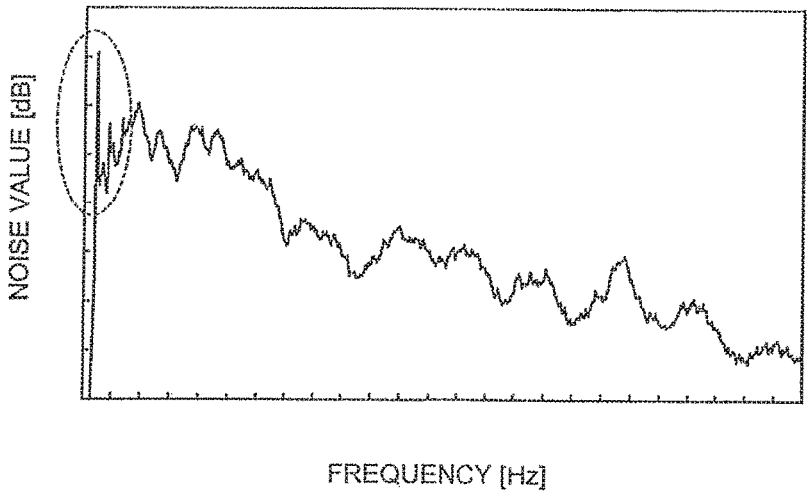
FIG. 8 is a diagram (the second) illustrating effects of rotation sound reduction by the fan according to Embodiment 2 of the present invention.

FIGS. 7 and 8 are diagrams illustrating effects of rotation sound reduction by the fan according to Embodiment 2 of the present invention. FIG. 7 shows a case in which a fan having a configuration, to which expression (1) and expression (2) are applied, is driven. FIG. 8 shows a case in which a conventional fan is driven. As shown in FIG. 7, a peak value of sound in the frequency $f_{NZ}$ is lower than that in FIG. 8, and therefore, it is understood that the rotation sound is reduced.

Embodiment 3

Although not particularly shown in the above-described Embodiment 1 and Embodiment 2, there is a possibility that a position of the center of gravity of the impeller 100 in the fan differs when the combination of the attachment pitch angles α is different. For example, even though the measures for the rotation sound described in Embodiment 1 or Embodiment 2 are taken, if the position of the center of gravity of the impeller 100 in the fan is significantly displaced from the center of the rotation axis, the impeller 100 is instable when rotating and becomes unbalanced; therefore, vibration of the impeller 100 is increased. When the vibration is increased, there is a possibility that the periodicity due to rotation occurs and the rotation sound is generated.

Consequently, in this embodiment, the blades 2 are arranged to include a combination of the attachment pitch angles by which the position of the center of gravity of the impeller 100 becomes nearest to the center of the rotation axis. Provision of combination of the attachment pitch angles by which the position of the center of gravity of the impeller 100 becomes nearest to the center of the rotation axis makes it possible to reduce the unbalanced state when the fan is driven and the impeller 100 is rotated. Therefore, it is possible to suppress vibration due to rotation of the impeller 100 and further reduce the rotation sound.

Embodiment 4

Figure 9:
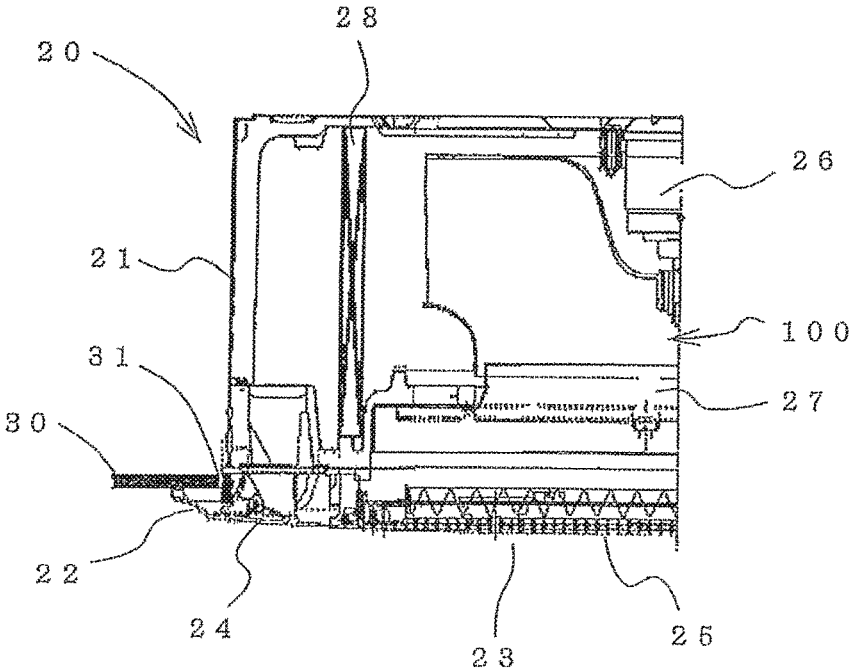
FIG. 9 is a diagram showing an air-conditioning apparatus according to Embodiment 4 of the present invention.

FIG. 9 is a diagram showing an air-conditioning apparatus according to Embodiment 4 of the present invention. FIG. 9 shows a partial cross-sectional view related to a configuration of, among the appliances constituting the air-conditioning apparatus, a ceiling-concealed indoor unit. In FIG. 9, the same sings are assigned to the same functional parts as those in the above-described Embodiment 1 or others.

A ceiling-concealed indoor unit 20 according to this embodiment is buried in the back of a ceiling 30, and a bottom-surface opening part is exposed from an opening part 31 of the ceiling 30. Then, a decorative panel 22 including an inlet 23 and an outlet 24 is attached to extend from the bottom-surface opening part of a main-body outer shell 21 to a rim of the opening part 31 of the ceiling 30. On a downstream side of the inlet 23, a filter 25 is provided.

A fan motor 26 of the fan is attached to a top panel of the main-body outer shell 21, and the boss 4 of the impeller 100 in the fan is fixed to an output axis of the fan motor 26, the fan being provided with the air inlet 1*a* of the shroud 1 positioned near the inlet 23 of the decorative panel 22. Between the inlet 23 of the decorative panel 22 and the air inlet 1*a* of the shroud 1 of the impeller 100 in the fan, a bell mouth 27 is provided. Moreover, a heat exchanger 28 is provided at the outer circumference of an air path from the inlet 23 to the outlet 24, the outer circumference being on the downstream side of the impeller 100 in the fan.

In the above-described air-conditioning apparatus including the ceiling-concealed indoor unit 20, when operation is started, the fan motor 26 of the fan is rotated and driven, and the impeller 100 fastened thereto is also rotated. By rotation of the impeller 100, air in a room is sucked from the inlet 23 and cleaned by the filter 25, and then flows into the impeller 100 from the bell mouth 27 to flow out toward the outer circumference from among the blades 2. The air flowed out of the impeller 100 passes through the heat exchanger 28, and is changed to cool or warm conditioned air to be blown out of the outlet 24 into the room.

According to the air-conditioning apparatus of Embodiment 4, it is possible to obtain an air-conditioning apparatus capable of reducing the rotation sound because the fan using the impeller 100 described in the above Embodiments 1 to 3 is included.

Note that, in the above description, a case using a fan according to the present invention to the indoor unit, which was shown in the drawings, of the air-conditioning apparatus was shown; however, the present invention is not limited thereto, and an indoor unit with any other configuration may be adopted. Further, the fan according to the present invention can be used in an outdoor unit of an air-conditioning apparatus or an air cleaner.

The invention claimed is:

1. A fan comprising:

a main plate fixed to a rotation axis of a driving device;

a shroud including an air inlet; and an impeller including n number of blades, where n>3 between the main plate and the shroud, tip ends of leading edges of the respective blades being arranged along a circle around the rotation axis, wherein, angles formed between the tip ends of leading edges of every two adjacent blades of all the blades and the rotation axis are defined as attachment pitch angles α, and each of the attachment pitch angles α has a different angle than other of the attachment pitch angles α, and the blades are arranged in such a manner that, in the attachment pitch angles α, attachment pitch angles on both sides of an attachment pitch angle $\alpha_m$, where $2\leq m\leq n-1$, are not a combination of an attachment pitch angle $\alpha_{m-1}$, which is an angle next small, in order of magnitude of angle, to the attachment pitch angle $\alpha_m$, and an attachment pitch angle $\alpha_{m+1}$, which is an angle next large, in order of magnitude of angle, to the attachment pitch angle $\alpha_m$, and wherein the blades are arranged with an attachment pitch angle $\alpha_1$ [deg] having a smallest angle and an attachment pitch angle $\alpha_n$ [deg] having a largest angle satisfying following expressions:

$$N/60\times360/\alpha_1\geq N/60\times n+10$$

$$N/60\times360/\alpha_n\leq/60\times n-10$$

where n represents a number of blades and N [rpm] represents a rotation speed.

2. The fan of claim 1, wherein the blades are arranged with a combination of the attachment pitch angles by which a position of a center of gravity of the impeller is closest to a center.

3. The fan of claim 1, wherein a number of blades is 5 to 9.

4. An air-conditioning apparatus comprising the fan of claim 1.

5. A fan comprising:

a main plate fixed to a rotation axis of a driving device;

a shroud including an air inlet; and an impeller including n number of blades, tip ends of leading edges of the respective blades being arranged along a circle around the rotation axis between the main plate and the shroud, wherein, angles formed between the tip ends of leading edges of every two adjacent blades of all the blades and the rotation axis are defined as attachment pitch angles $\alpha$, and each of the attachment pitch angles $\alpha$ has a different angle than other of the attachment pitch angles $\alpha$, and the blades are arranged with an attachment pitch angle $\alpha_1$ [deg] having a smallest angle and an attachment pitch angle $\alpha_n$ [deg] having a largest angle satisfying following expressions:

$$N/60\times360/\alpha_1\geq N/60\times n+10$$

$$N/60\times360/\alpha_n\leq/60\times n-10$$

where n represents a number of blades and N [rpm] represents a rotation speed.

* * * * *